United States Patent [19]

Rosenberg

[11] Patent Number: 4,836,422

[45] Date of Patent: Jun. 6, 1989

[54] PROPELLANTLESS FOAM DISPENSER

[75] Inventor: Werner Rosenberg, Vienna, Austria

[73] Assignee: Henkel Kommanditgesellschaft auf Aktien, Duesseldorf, Fed. Rep. of Germany

[21] Appl. No.: 154,731

[22] Filed: Feb. 11, 1988

[30] Foreign Application Priority Data

Feb. 11, 1987 [AU] Australia ..... 288/87

[51] Int. Cl.[4] ..... B67D 5/58

[52] U.S. Cl. ..... 222/190; 222/211; 222/212; 222/493; 222/495; 222/488; 239/327

[58] Field of Search ..... 222/190, 189, 488, 206, 222/211, 212, 500, 491, 492, 493, 495, 335; 239/327

[56] References Cited

U.S. PATENT DOCUMENTS

| | | | |
|---|---|---|---|
| 3,422,993 | 1/1969 | Boehm et al. | 222/190 |
| 3,985,271 | 10/1976 | Gardner | 222/211 X |
| 4,022,351 | 5/1977 | Wright | 222/190 X |
| 4,184,615 | 1/1980 | Wright | 222/212 X |
| 4,286,735 | 9/1981 | Sneider | 222/215 X |
| 4,635,826 | 1/1987 | Hatakeyama et al. | 222/495 X |
| 4,673,110 | 6/1987 | Workum | 222/211 |

*Primary Examiner*—Kevin P. Shaver
*Assistant Examiner*—Gregory L. Huson
*Attorney, Agent, or Firm*—Ernest G. Szoke; Wayne C. Jaeschke; Real J. Grandmaison

[57] ABSTRACT

A propellantless foam dispenser comprising a container which has a flexible outer wall and contains a foamable liquid and air. The container has an outlet opening which is disposed at the top of the container and has a foam discharge nozzle associated with it. A foam generator is associated with the outlet opening and comprises a body that includes a bottom member and a shell member and contains a porous element which covers the air inlet opening of the foam discharge nozzle. The bottom member of the foam generator body is formed with liquid passage openings and with an air passage opening. A tubular air line is provided which communicates with the air passage opening and extends into the interior of the container close to the base of the container. A mixing chamber is provided between the bottom member of the body of the foam generator and the porous element which comprises a sieve disc. The sieve disc is contained in and defines a radial clearance with the shell member of the body of the foam generator and is axially displaceable in the shell member under a superatmospheric pressure in the container whereby it is urged to a first end position whereat the disc engages a peripheral flange which surrounds the inlet opening of the foam discharge nozzle. Under a subatmospheric pressure in the container, the disc is urged to a second end position which is defined by at least one stop and in which air entering the foam discharge nozzle from the outside will flow between the sieve disc and the shell member of the foam generator body into the mixing chamber and flow into the interior of the container through the air passage opening in the bottom member of the body of the foam generator and through the air line.

19 Claims, 4 Drawing Sheets

Fig.1
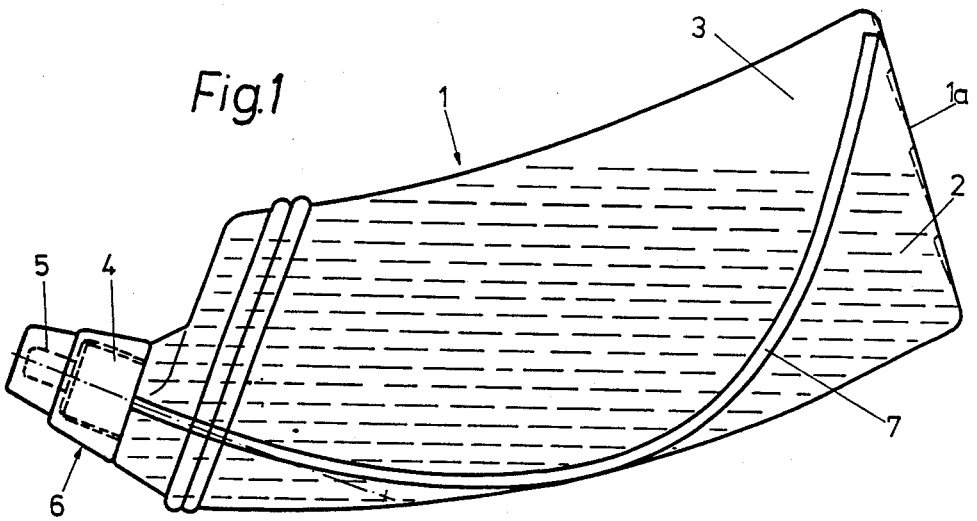
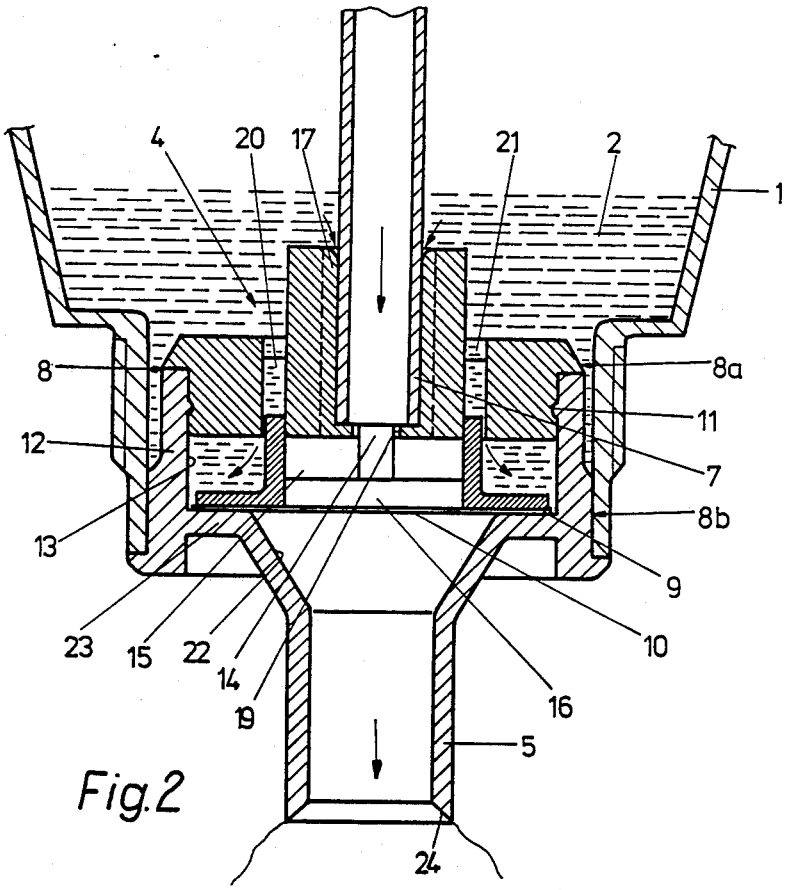
Fig.2

Fig.4
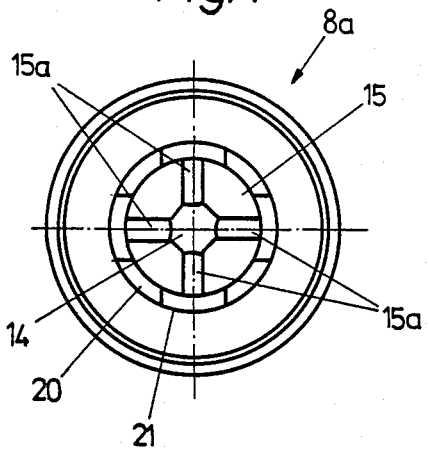
Fig.7
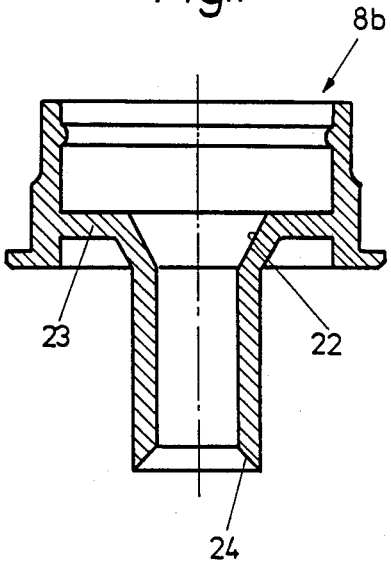
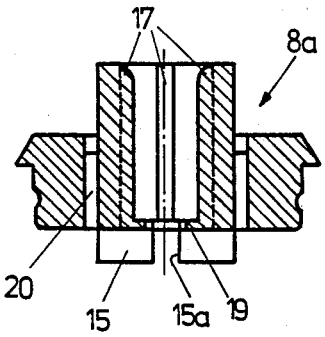
Fig.5
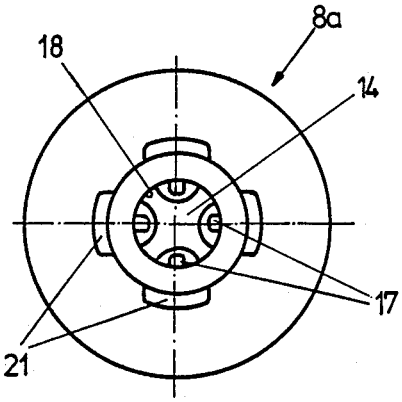
Fig.6
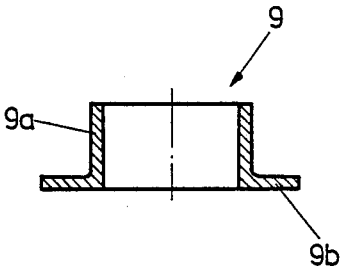
Fig.8

PROPELLANTLESS FOAM DISPENSER

BACKGROUND OF THE INVENTION

1. Field of the Invention

This invention relates to a propellantless foam dispenser comprising a container which has a flexible outer wall and contains a foamable liquid and air, such as for instance, a hand-squeezable bottle. The container comprises a base, which is preferably adapted to be placed on a support, and an outlet opening which is disposed at the top of the container and has a foam discharge nozzle associated with it. The dispenser also comprises a foam generator which comprises a body which is fitted in the discharge opening, and when the container is in an inverted position so that the foam generator is disposed below the liquid level in the container, the foam generator is adapted to discharge foam from the container as the latter is squeezed. The body of the foam generator comprises a shell member that is fitted in the outlet opening and a bottom member that is connected to the shell member and contains a porous element, which covers the inlet opening of the foam discharge nozzle. The bottom member is formed with liquid passage openings and with an air passage opening, and a tubular air line is provided which communicates with the air passage opening and extends into the interior of the container close to the base of the container.

2. Discussion of Related Art

A foam dispenser of the afore-mentioned kind is known from FIGS. 3 to 5 of U.S. Pat. No. 3,422,993 and is adapted to dispense, e.g., detergents, polishes and cosmetic preparations in the form of foams. In said foam dispenser the porous element of the foam generator consists of a sponge, which entirely fills the body of the foam generator. As the container is squeezed by hand when it is in an inverted position for use wherein the tubular air line extends into the air space in the container, liquid is forced through the liquid passage openings of the body of the foam generator, and air is simultaneously forced through the tubular air line and the air passage opening so that said liquid and air will enter the sponge and will be mixed in said sponge to form a foam which will then be discharged from the dispenser through the foam discharge nozzle. When the container is subsequently relieved from pressure and returns to its original shape, the container will inhale air which enters from the outside through the foam discharge nozzle and must pass through the sponge before it can enter the interior of the container through the air passage opening of the foam generator and the air line. Because the air must pass through the sponge, the air will be inhaled very slowly so that the user of the foam dispenser must wait for a rather long time before additional foam can be dispensed. Another disadvantage of the known foam dispenser is the fact that the air which during its inhalation passes through the sponge will mix with residual liquid in said sponge so that the air space in the container will soon be filled with foam and a satisfactory discharge of foam will no longer be ensured. That result will be promoted by the fact that the liquid passage openings in the foam generator have a relatively large flow area so that part of the air being inhaled will pass through said liquid passage openings and through the column of liquid that is contained in the container. This will result in the generation of additional foam in the container.

DESCRIPTION OF THE INVENTION

It is an object of this invention to eliminate the above-mentioned disadvantages of the prior art and to provide a foam dispenser wherein air which is being inhaled through the foam discharge nozzle need not pass through the porous element and can flow freely into the air space in the container.

In a foam dispenser described as hereinbefore, said object is accomplished in accordance with this invention wherein a mixing chamber is provided between the bottom member of the body of the foam generator and the porous element. The porous element comprises a sieve disc which is contained in and defines a radial clearance with the shell of the body of the foam generator and is axially displaceable in said shell and under a superatmospheric pressure in the container is urged to a first end position wherein said disc engages a peripheral flange which surrounds the inlet opening of the foam discharge nozzle. Under a subatmospheric pressure in the container, the disc is urged to a second end position which is defined by at least one stop and in which air entering the foam discharge nozzle from the outside will flow between the sieve disc and the shell member of the foam generator into the mixing chamber and is adapted to flow into the interior of the container through the air passage opening in the bottom member of the body of the foam generator and through the air line.

If the sieve disc comprises a flexible material, e.g., a woven fabric of nylon or the like, so that the sieve disc if it were not retained might be extruded outwardly through the foam discharge nozzle under a superatmospheric pressure in the container, it is possible within the scope of the invention to provide the foam generator with a tubular piston which is disposed between the sieve disc and the bottom of the body of the foam generator and is displaceable in the axial direction of the foam generator, and which is provided with an annular flange that extends at right angles to the axis of the piston and under a superatmospheric pressure in the container will urge the peripheral portion of the sieve disc against the peripheral flange which surrounds the inlet opening of the foam discharge nozzle. Such a piston is desirably guided in an annular groove that is formed in the bottom of the body of the foam generator on the side which faces the mixing chamber, with a plurality of openings extending from the bottom of said groove through the bottom of the body of the foam generator to the interior of the container, and an air passage opening and liquid passage openings in the bottom of the body of the foam generator which open into the annular groove. In such case, any superatmospheric or subatmospheric pressure in the interior of the container will be applied to that end of the piston which faces the interior of the container.

If the air passage opening is centrally disposed in the bottom of the body of the foam generator and is surrounded by a portion containing the liquid passage openings, as in the known foam dispenser, it is contemplated within the scope of this invention to design the liquid passage openings so that their open ends facing the mixing chamber are close to and preferably merge with the air passage opening. In that case the air and liquid will be intensely mixed even as they enter the mixing chamber so that the foam being dispensed will have a constant consistency.

The stop which defines the second end position of the sieve disc is preferably formed by a centrally disposed boss which is formed on the bottom of the foam generator on the side which faces the mixing chamber, and said boss may have lateral openings which communicate with the air passage opening. If the second end position of the sieve disc is defined by a plurality of stops, said stops may be formed by a plurality of projections provided on the shell member or the bottom member of the body of the foam generator, and said projections are preferably evenly spaced about the periphery of the foam generator.

In a preferred embodiment of this invention, the body of the foam generator comprises two members which are joined preferably by a snap joint, one of which substantially comprises the bottom member of the body, whereas the other comprises the shell member of the body and is formed with a peripheral flange that surrounds the inlet opening of the foam discharge nozzle and also forms the foam discharge nozzle.

Also within the scope of this invention, it is contemplated to provide a foam discharge nozzle having a conical inlet opening, which preferably has an included angle of about 60°. In such case, the effective cross-sectional area of the sieve disc is increased, and an injector is provided which increases the velocity at which the foam is discharged so that a directed discharge of the foam over a certain distance can be effected even when the foam discharge nozzle does not extend vertically downwardly.

When the foam is to be discharged horizontally or even upwardly, e.g., in a dispenser used to clean a watercloset wherein the detergent is to be deposited behind the depending inner rim of the bowl, the axis of the foam generator and of the foam discharge nozzle may be inclined relative to the base of the container. This arrangement can be achieved in a simple manner whereby the outlet opening of the container is inclined relative to the axis of the container.

The container may suitably have a small thickness, and may have narrow side walls which are similarly curved in their longitudinal direction, and the axis of the foam generator and of the foam discharge nozzle may extend toward that side on which the narrow side walls of the container are concave whereas the inner end of the air line may be disposed close to that concave side of the narrow side wall of the container. The greater the curvature of the side walls of the container and the larger the inclination of the axis of the foam generator and of the foam discharge nozzle from the base of the container, the steeper may be the direction in which the foam is upwardly discharged.

Finally, the free nozzle rim which defines the discharged opening of the foam discharge nozzle is beveled, preferably at an angle of about 45° C. In that case, the foam being discharged from the foam discharge nozzle will readily be separated from said nozzle when the discharge of foam has been terminated and no part of the foam will undesirably adhere o said nozzle.

BRIEF DESCRIPTION OF THE DRAWINGS

FIG. 1 is a diagrammatic view depicting a foam dispenser embodying the invention, and forming a so-called watercloset cleaner.

FIG. 2 is an enlarged axial sectional view depicting a first embodiment of the foam generator of the foam dispenser embodying the invention during a discharge of foam through a vertically downwardly directed foam discharge nozzle.

FIGS. 4, 5, and 6 depict the bottom member of the body of the foam generator shown in FIGS. 2 and 3 wherein FIG. 4 is a bottom view, FIG. 5 is an axial sectional view, and FIG. 6 is a top plan view.

FIG. 7 is an axial sectional view depicting that member of the body of the foam generator shown in FIGS. 2 and 3 which constitutes the shell of said body, the foam discharge nozzle and the radial peripheral flange which surrounds the inlet opening of said nozzle.

FIG. 8 is an axial sectional view depicting the piston shown in FIGS. 2 and 3.

DETAILED DESCRIPTION OF THE DRAWINGS

Figure 3:
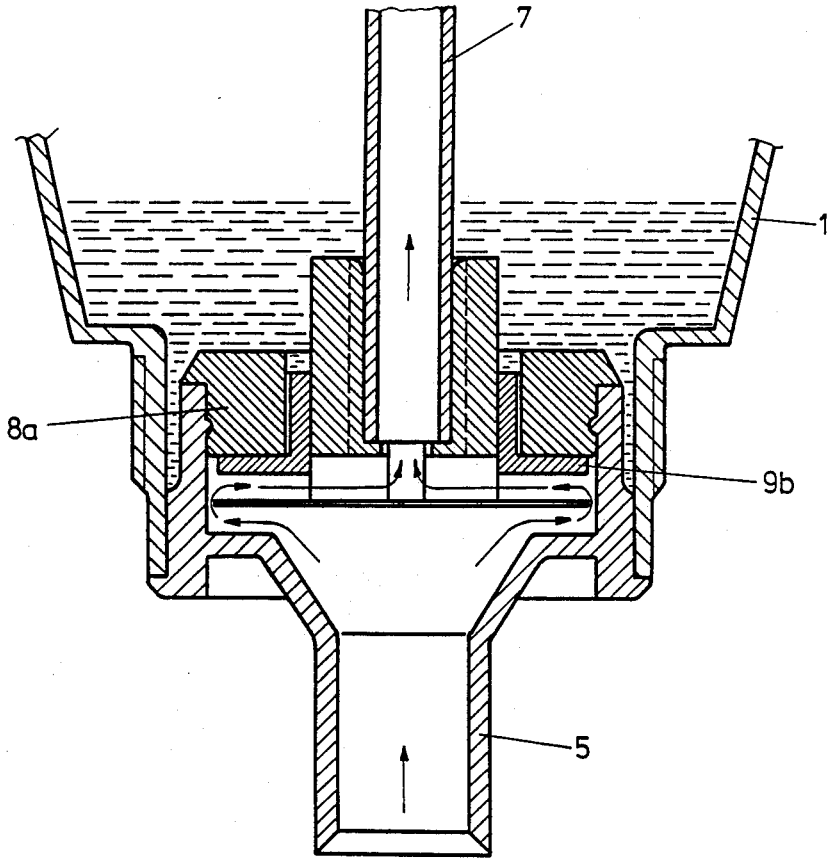
FIG. 3 is a sectional view similar to FIG. 2, but showing the foam generator during an inhalation of air.

Two embodiments of the invention will now be described in more detail with reference to the accompanying drawings.

The foam dispenser shown in FIG. 1 comprises a relatively thin container 1 which is made of flexible material, preferably of plastic, and which initially contains a foamable liquid 2, in the present case a watercloset cleaning detergent solution, which occupies about 75% of the volumetric capacity of the container, and air, which occupies about 25% of the volumetric capacity of the container. The container has an outlet opening, with which a foam generator 4 and a foam discharge nozzle 5 are associated and which is closed by a screw cap 6. The illustrated foam dispenser is intended to dispense foam when the container 1 is in an inverted position so that the foam generator 4 is disposed below the liquid level in the container. In the present case, it may be desired to discharge the foam also in an upwardly inclined direction so that the foam can be deposited behind the depending inner rim of a watercloset bowl. To permit a discharge of foam in such an upwardly inclined direction, the narrow side walls of the container are curved to one side and the axis of the foam generator 4 and of the foam discharge nozzle 5 is inclined from the base 1a of the container. That base is adapted to be placed on a support. An air line 7 extends from the foam generator 4 into the interior of the container and has a free end that is disposed close to the transition between the base 1*a* and the concave side of the side wall of the container. As a result, when the container is in its inverted position for use, the air line will always extend into the air space 3 in the container 1.

In the embodiment shown in FIGS. 2 to 8, the foam generator 4 comprises a body 8, a displaceable piston 9, and a sieve disc 10. The body 8 is composed of two members 8*a* and 8*b*, which are detachably interconnected by a snap joint 11. The member 8*a* forms a bottom of the body 8. The member 8*b* comprises a shell 12, which is fitted in the outlet opening 13 of-the container, and a portion which adjoins the shell 12 and forms the foam discharge nozzle 5.

As is particularly apparent from FIGS. 4 to 6 the member 8*a* which forms the bottom of the foam generator body is formed with a centrally disposed air passage opening 14 which communicates with the air line 7 that extends into the interior of the container on that side which faces the foam discharge nozzle 5. The bottom member is provided with a centrally disposed boss 15, which has four radial indentations—15*a*. Through said boss the air passage opening 14 opens axially and radially into a mixing chamber 16, which is defined by the bottom member 8a and the sieve disc 10. The surface that defines the air passage opening 14 is provided with longitudinal ribs 17 which frictionally engage and restrain the air line 7. Owing to that arrangement, passage openings 18 for liquid to be discharged are defined by the ribs 17, the air line 7, and the surface which defines the air passage opening 14. Posterior to the outlet end of the air line 7, the liquid passage openings 18 merge into the air passage opening 14 at location 19 (FIGS. 2 and 5) before the latter opens into the mixing chamber.

The bottom member 8a is formed with an annular groove 20 on the side which faces the fixing chamber. Annular groove 20 serves to guide the piston 9. Four peripherally spaced apart openings 21 extend from the bottom of the groove 20 through the bottom member 8*a* to the interior of the container.

The piston 9 comprises a cylindrical tube 9a and an annular flange 9*b* (FIG. 8), which extends radially outwardly from the tube 9*a* and is smaller in diameter than the inside surface of the shell member 12.

The sieve disc 10 comprises a thin woven fabric of nylon and is also smaller in diameter than the inside surface of the shell member 12.

The mode of operation of the afore-described embodiment will now be explained. When the container 1 is squeezed by manual pressure applied to its broad side walls, a superatmospheric pressure is generated in the interior of the container so that air will flow into the mixing chamber from the air space 3 in the container through the air line 7 and the air passage opening 14 formed in the bottom member of the body of the foam generator, and liquid from the container will enter the mixing chamber 16 through the liquid passage opening 18. Liquid will enter the annular groove 20 in the bottom member 8*a* through the openings 21 at the same time and will urge the piston 9 and the sieve disc 10 toward the foam discharge nozzle 5. At this time, the liquid-air mixture in the mixing chamber 16 will also act on the sieve disc 10. During that operation, the rim portion of the sieve disc 10 will move into engagement with radial peripheral flange 23 which surrounds the inlet opening 22 of the nozzle 5, and said rim of the sieve disc 10 will be forced strongly against peripheral flange 23 by the annular flange 9b of piston 9 and will thus be held in position. The sieve disc must be retained in that manner because the woven nylon fabric which constitutes the sieve disc does not have an adequate inherent stiffness to withstand the pressure of the liquid-air mixture so that the sieve disc might be extruded through the foam discharge nozzle. As the application of pressure to the container wall is continued, the liquid-air mixture is forced through sieve disc 10 and is discharged as a foam from the foam discharge nozzle 5.

When container 1 is relieved from the manually applied pressure and returns to its original shape, a subatmospheric pressure will be generated in the interior of the container and will urge piston 9 and sieve disc 10 to the position which is shown in FIG. 3. In that position, sieve disc 10 engages the centrally disposed boss 15 of the bottom member 8*a*, and the annular flange 9*b* of piston 9 engages the bottom member 8*a*. At least a major part of the air entering the foam discharge nozzle 5 will then flow between the sieve disc 10 and the shell 12 of the body 8 and through the lateral openings which are formed by the indentations 15*a* of the boss 15 of the bottom member 8*a* into the air passage opening 14 and from the latter through the air line 7 into the air space 3 in the container 1. As a result, that inhalation of air into the container will take place very quickly and virtually without the formation of foam in the container. Additional foam can be dispensed as soon as the original form of the container has been restored.

As is apparent from FIGS. 2, 3 and 7, the foam discharge nozzle 5 comprises a conical inlet portion 22 so that the effective sieve area of the sieve disc 10 is increased and an injector is provided, which will cause the foam to be discharged at a higher velocity so that a directed discharge of foam over a certain distance can be effected even when the nozzle is not downwardly directed but is, e.g., horizontally directed.

In practice it has been found that a conical inlet portion 22 having an included angle of about 60° is particularly desirable. The embodiment which is illustrated is capable of a directed horizontal discharge of the foam over a distance of 20 to 25 cm.

It is also desirable to provide the foam discharge nozzle at its outlet end with a rim 24 which is beveled, preferably at an angle of about 45°. In that case, the foam will easily be separated from the foam discharge nozzle 5 when the pressure applied to the container 1 is decreased.

The velocity at which the foam is discharged from the foam discharge nozzle 5 will depend on the cross-section and the length of the cylindrical portion of the nozzle 5. The foaming characteristics of the liquid and the cross-section of the liquid passage openings 18 will determine the consistency of the foam that is discharged. The cross-section of the air passage opening 14 in the bottom member of the foam body generator and the cross-section of the air line 7 will determine the velocity at which the air enters the mixing chamber 16 and, as a result, the quantity of foam which is produced for one shot and the force that is required to produce the foam.

The liquid passage openings 18 desirably merge into the air passage opening 14, as in the present embodiment, because the injector action thus obtained will result in a mixing of the liquid and air even before they enter the mixing chamber. Although such a design is regarded as being most advantageous, the merging of the liquid passage openings into the air passage opening is not essentially required. But those ends of the liquid passage openings which are adjacent to the mixing chamber should be as close as possible to the air passage opening so that an effective mixing in the mixing chamber will be ensured.

During an inhalation of air into the container, an ingress of air through the liquid passage openings should substantially be inhibited. For this purpose the cross-section of each liquid passage opening should be as small as possible. If the liquid that is to be foamed has such a viscosity and such foaming characteristics that said liquid must be supplied at a higher rate than the detergent solution used in the present embodiment, it will be desirable to increase the number rather than the cross-sectional area of the liquid passage openings.

For an economical manufacture of the container 1 of the kind shown in FIG. 1 it is important that during the insertion of the foam generator 4 and of the air line 7 attached thereto into the container 7 that the free end of the air line is reliably moved to the proper position in the container. For that purpose the base 1a of the container gradually merges via a properly curved transitional portion into the side walls of the container and has such a shape that the end of the air line will slide on said base 1a to the proper final position. To that end, the inside surface of the base 1*a* of the container is free of any edges or the like which could obstruct the sliding of the end of the air line 7 on the inside surface of the base 1*a*. As the container base 1*a* is intended to be placed on a support, the base 1*a* is desirably only slightly crowned and is formed with a smooth surface or provided with stiffening means in the form of shingles, such as are indicated by way of example with dotted lines in FIG. 1.

The two components 8*a*, 8*b* of the foam generator body 8 and the piston 9 are suitably injection-molded from polyethylene or polypropylene.

Figure 9:
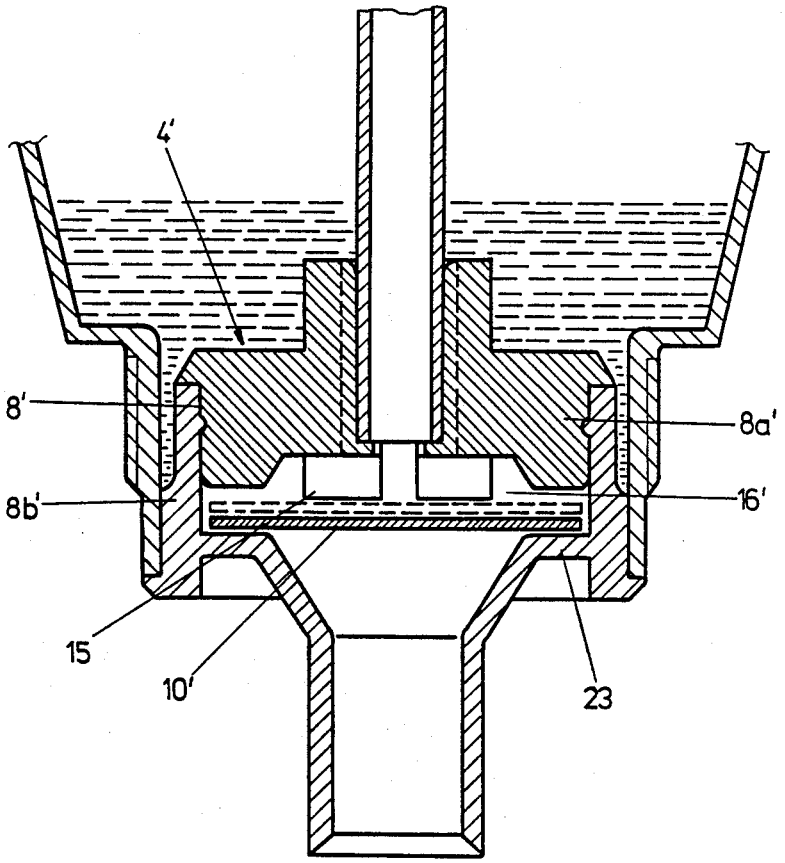
FIG. 9 is a view that is similar to FIGS. 2 and 3 and depicts a second embodiment of the foam generator of the foam dispenser embodying the invention.

In the embodiment shown in FIG. 9 the foam generator 4′ differs from the one described hereinbefore only in that the sieve disc 10′ consists of a stiff sieve, which is made, e.g., of metal. In that case the piston 9, the annular groove 20 and the openings 21 provided in the embodiment described above may be omitted. As the container is squeezed, the pressure of the liquid-air mixture contained in the mixing chamber is applied to the sieve disc 10′ and urges the latter against the peripheral flange 23. Upon a decrease of the external pressure applied to the container, the subatmospheric pressure then prevailing in the container will draw the sieve disc 10′ into engagement with the centrally disposed boss 15 of the bottom member 8*a*.

It will be understood that the illustrative embodiments described hereinbefore can be modified in various respects without a departure from the scope of the invention. For instance, the boss 15 which constitutes a single stop for the sieve discs 10 or 10′ may be replaced by a plurality of stops, which may be provided on the shell member or on the bottom member of the foam generator body 8 or 8; and which will preferably be evenly distributed around the periphery and will limit the stroke of the sieve disc. In order to permit the foam dispenser shown in FIG. 1 to discharge upwardly in a steeply inclined or even in a vertical direction, the tube which constitutes the foam discharge nozzle may properly be curved or angled. It is also possible to provide a flexible duct, which in case of need can be fitted on the foam discharge nozzle and which permits a deposition of foam at locations which otherwise would not be accessible.

I claim:

1. In a propellantless foam dispenser comprising: a container having a flexible outer wall which includes a base, side wall means, and a top end that is formed with an outlet opening, said container containing a foamable liquid and having an air space with said outer wall; a foam discharge nozzle associated with said outlet opening and having an inlet opening in said outlet opening of said container; said container being movable to an inverted position whereby said outlet opening is disposed below the level of said liquid in said container; a foam generator which is contained in said outlet opening and when said container is squeezed in said inverted position to generate a superatmospheric pressure in said container is adapted to generate foam and to deliver said foam to said inlet opening; said foam generator comprising a body having a shell member which is mounted in said outlet opening, and a bottom member connected to said shell member remote from said inlet opening; said foam generator containing a porous element which faces and covers said inlet opening; said bottom member being formed with liquid passage openings and with an air passage opening, and said foam dispenser also comprising a tubular air line which communicates with said air passage opening and extends therefrom close to said base; wherein the improvement comprises that said porous element comprises a sieve disc which defines a radial clearance with said shell member and is axially displaceable in said body between a first end position and a second end position in both positions of which said sieve disc is axially spaced apart from and defines a mixing chamber with said bottom member; said body further comprising a peripheral flange which extends radially inwardly from said shell member and surrounds said inlet opening and is engageable by said sieve disc to define said first end position; said body further comprising stop means which are engageable by said sieve disc to define said second end position; said sieve disc being adapted to move to said first end position and said second end position, respectively, in response to a superatmospheric pressure and to a subatmospheric pressure in said container, respectively; whereby at least a major part of the air which enters said foam discharge nozzle from the outside of said dispenser can flow through said radial clearance past said sieve disc into said mixing chamber and through said air passage opening and said air line into said container when said sieve disc is in said second position.

2. A dispenser as in claim 1 wherein said container comprises a bottle which is adapted to be squeezed by hand.

3. A dispenser as in claim 1 wherein said base is adapted to be placed on a support.

4. A dispenser as in claim 1 wherein said stop means comprise a boss which is carried by and centrally disposed on said bottom member on the side thereof which faces said mixing chamber, and said boss is formed with lateral openings which communicate with said air passage opening.

5. A dispenser as in claim 1 wherein a tubular piston is disposed in said mixing chamber and is axially displaceable therein, and is provided with an annular flange which extends at right angles to the axis of said piston and is arranged to urge a peripheral portion of said sieve disc against said peripheral flange in response to a superatmospheric pressure in said container.

6. A dispenser as in claim 5 wherein said bottom member is formed in its surface facing said mixing chamber with an annular groove having a bottom surface, said piston extends into and is slidably guided in said annular groove, said bottom member is formed with a plurality of passage openings extending from said bottom surface of said groove, and said air passage opening and said liquid passage openings open toward said mixing chamber radially inwardly of said annular groove.

7. A dispenser as in claim 1 wherein said air passage opening is centrally disposed in said bottom member and said bottom member has a portion surrounding said air passage opening and formed with said liquid passage openings, wherein said liquid passage openings open into said mixing chamber close to said air passage opening.

8. A dispenser as in claim 7 wherein said liquid passage openings open into said air passage opening before the latter opens into said mixing chamber.

9. A dispenser as in claim 1 wherein said shell member comprises said peripheral flange and said foam discharge nozzle.

10. A dispenser as in claim 9 wherein said bottom member and said shell member are connected by a snap joint.

11. A dispenser as in claim 1 wherein said foam discharge nozzle has a conical inlet portion which extends outwardly from and tapers from said inlet opening.

12. A dispenser as in claim 11 wherein said conical inlet portion has an included angle of about 60°.

13. A dispensed as in claim 1 wherein said foam generator body and said foam discharge nozzle have a common axis which is inclined from said base.

14. A dispenser as in claim 13 wherein said air line has a free end that is remote from said bottom member and disposed close to said side wall means, wherein said side wall means comprise two mutually opposite, broad side walls and two mutually opposite narrow side walls, said narrow side walls being similarly curved in their longitudinal direction so that said narrow side walls are outwardly concave and convex, respectively, said common axis of said foam generator body and said foam discharge nozzle extends from said foam generator body toward the outwardly concave narrow side wall, and said free end of said air line is disposed close to the outwardly concave narrow side wall.

15. A dispensed as in claim 1 wherein said foam discharge nozzle has opposite to said inlet opening a discharge en formed with a beveled rim.

16. A dispenser as in claim 15 wherein said rim is beveled at an angle of about 45°.

17. A dispenser as in claim 1 wherein said stop means comprises a plurality of projections carried by said body.

18. A dispenser as in claim 17 wherein said projections are carried by said bottom member.

19. A dispenser as in claim 17 wherein said projections are evenly peripherally spaced apart.

* * * * *